United States Patent [19]

Gimpera

[11] Patent Number: 4,905,876

[45] Date of Patent: Mar. 6, 1990

[54] ELECTROMAGNETICALLY ACTUATABLE VALVE FOR A METALLURGICAL VESSEL

[75] Inventor: José Gimpera, Wiesbaden, Fed. Rep. of Germany

[73] Assignee: Didier-Werke AG, Wiesbaden, Fed. Rep. of Germany

[21] Appl. No.: 326,035

[22] Filed: Mar. 20, 1989

[30] Foreign Application Priority Data

Mar. 18, 1988 [DE] Fed. Rep. of Germany ..... 3809072

[51] Int. Cl.[4] ..... B22D 41/08

[52] U.S. Cl. ..... 222/598; 266/237

[58] Field of Search ..... 266/236, 237; 222/590, 222/591, 598, 599

[56] References Cited

U.S. PATENT DOCUMENTS 3,165,795 1/1965 Bahm ..... 222/598

3,760,992 9/1973 Bieri ..... 222/598

4,655,237 4/1987 Gloor et al. ..... 266/237

FOREIGN PATENT DOCUMENTS 8805355 7/1988 European Pat. Off. ..... 222/598

*Primary Examiner*—S. Kastler

*Attorney, Agent, or Firm*—Wenderoth, Lind & Ponack

[57] ABSTRACT

A rotary and/or axial slide plate valve for controlling the discharge of molten metal from a metallurgical vessel includes a refractory fixed valve part and a refractory movable valve part at least partially disposed within the fixed valve part, the valve parts having respective peripheral surfaces which establish a seal therebetween. An electromagnetic drive is provided for moving the movable valve part between open and closed positions of the valve. The electromagnetic drive may facilitate rotary and/or axial movement of the movable valve part.

29 Claims, 4 Drawing Sheets

ELECTROMAGNETICALLY ACTUATABLE VALVE FOR A METALLURGICAL VESSEL

BACKGROUND OF THE INVENTION

The present invention relates to a rotary and/or axial slide valve for controlling the discharge of molten metal from a metallurgical vessel, the valve including refractory inner and outer valve parts one of which is to be fixed when in use and the other of which is to be movable between an open and a closed position of the valve, and a drive means for rotating and/or sliding the other of said valve parts between the open and closed positions of the valve. The present invention also relates to the refractory valve parts employable in such a valve, and to an assembly in which such a valve is integral with refractory lining material of a metallurgical vessel.

Known valves of the aforementioned type employ drive means which are time-consuming to manufacture and occupy a relatively great amount of space when in use. Such drive means generally require various supply lines, for example, for supplying compressed air or hydraulic fluid. Similar supply lines are required for the actuators of the drive means. Such structure is relatively costly to maintain. Furthermore, the work associated with the replacement of the refractory parts is relatively difficult as such usually involves the uncoupling of the drive means from the parts.

A rotary and slide valve of this type is described in German application P 37 31 600. In a first embodiment, the valve is mounted externally of the metallurgical vessel. In a second embodiment, the valve is mounted within the vessel, and a movable valve part extends through the vessel wall to the exterior thereof.

Other known valves of the aforementioned type are disclosed in DE-PS No. 35 40 202 and U.S. Pat. No. 3,651,998. In the valve disclosed in DE-PS No. 35 40 202, a guide rod extends upwardly through the molten metal in the vessel and is fastened to a movable valve part. This valve requires expensive refractory insulation or sealing material for the drive means. In the valve disclosed in U.S. Pat. No. 3,651,998, the drive element of the movable valve part extends through the fixed valve part. A mounting of the drive means to the movable shutoff part and the guiding thereof through the fixed valve part creates problems when such a valve is used to discharge molten metal.

SUMMARY OF THE INVENTION

An object of the present invention is to provide a valve which overcomes the problems mentioned above in the prior art due to the provision of a drive means that does not extend through the molten metal and which does not have to extend through a vessel wall of a metallurgical vessel when used therewith.

More specifically, the present invention provides an electromagnetic drive means for rotating and/or axially sliding a movable valve part of the valve. The electromagnetic drive means of the present invention obviates the necessity of mechanical, hydraulic or pneumatic drive mechanisms and the supply lines, drive elements and actuators associated therewith. A coil of the electromagnetic drive means may be mounted to the metallurgical vessel at a portion thereof or to the fixed valve part. Consequently, an electrical connection with the coil can be established easily and without the need for a great amount of space. Thus, it is also possible to integrate the electromagnetic drive means into an electrical control circuit for controlling the operation of the entire molten metal discharge system.

Another advantage of the present invention resides in that the electromagnetic drive means does not provide an obstacle to the removal of the movable valve part during the maintenance thereof.

Finally, according to the invention, at least one permanent magnet or at least one iron core of the electromagnetic drive means is provided integrally with the movable valve part while at least one coil of the electromagnetic drive means is, as discussed above, provided integrally with the fixed valve part or with a lining of the vessel.

BRIEF DESCRIPTION OF THE DRAWINGS

Other objects, features and advantages of the present invention will be apparent from the following detailed description of preferred embodiments thereof, wherein.

DETAILED DESCRIPTION OF THE PREFERRED EMBODIMENTS

Figure 1:
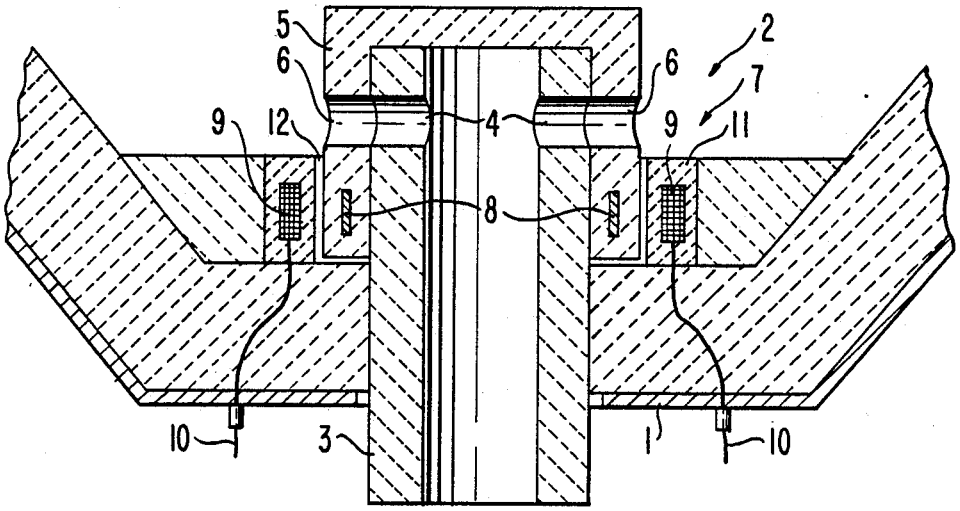
Fig. 1 is a schematic sectional view of a rotary valve according to a first embodiment of the present invention.

Reference numeral 2 designates a valve according to the present invention fixed to the lining 1 of a metallurgical vessel.

In the embodiments shown in FIGS. 1–4, a refractory fixed valve part 3, preferably of ceramic, is an inner valve part having the shape of a pipe extending in a generally vertical direction. The fixed valve part 3 has a plurality of through-holes 4 extending therethrough forming part of a channel through the inner valve part. Another refractory valve part 5, also preferably of ceramic, is an outer valve part that is movable relative to the inner valve part. The fixed 3 and movable 5 valve parts have peripheral surfaces that are complementary to one another so as to establish a seal therebetween.

The refractory valve part 5 has a tubular shape that is closed at one end, and a plurality of through-holes 6 extending therethrough which define an inlet port of the valve. The movable valve part 5 can be rotated by electro-magnetic drive means (to be described below) between an open position of the valve 2 at which the inlet port defined by through-holes 6 is open to the through-holes 4 defining the channel through the fixed valve part 3 and a closed position of the valve 2 at which the seal established by the peripheral surfaces of the valve parts closes the inlet port defined by through-holes 6 to the channel extending through the fixed valve part 3.

The electromagnetic drive means 7 includes a first component 8 comprising at least one permanent magnet or at least one iron core (or other magnetizable material), and a second component 9 comprising at least one coil. The first component 8 is integral with the movable valve part 5, for example, is embedded therein. The second component 9 of the electromagnetic drive means is integral with the lining of the vessel and/or the fixed valve part 3. Reference numeral 10 designates leads connected to the coils.

More specifically, in the embodiment of FIG. 1, two permanent magnets or iron cores are embedded in the movable valve part 5. In a modified version, more than two permanent magnets or iron cores are spaced circumferentially within the movable valve part 5. However, in principle, one permanent magnet or one iron core can suffice.

A respective coil constituting the second component 9 of the electromagnetic drive means is associated with each permanent magnet or iron core. Each coil is mounted to the lining 1 adjacent the movable valve part 5. A protective sheath 11 is disposed around each coil or, alternatively, a common sheath is disposed around all of the coils, so as to shield the coils from the molten metal. A gap 12 is provided between the sheath 11 and movable valve part 5.

According to this embodiment, the movable valve part 5 can be rotated in opposite directions to move the movable valve part 5 between the open and closed positions of the valve.

Alternatively, the movable valve part 5 may be rotated in only a single direction by the electromagnetic drive means to move the movable valve part 5 between the open an closed positions due to the arrangement of the through-holes 4, 6.

Figure 2:
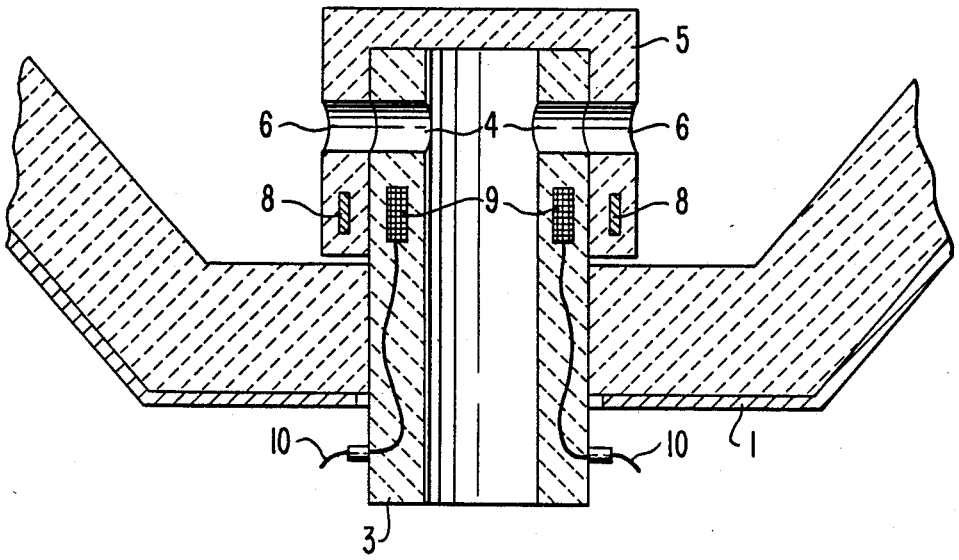
FIG. 2 is a schematic sectional view of another embodiment of a rotary valve according to the present invention.

The embodiment of the present invention shown in FIG. 2 is essentially the same as that shown in FIG. 1 with the exception that the second component 9 of the electromagnetic drive means in the embodiment shown in FIG. 2 is integral with the fixed valve part 3. Thus, the embodiment shown in FIG. 2 obviates the necessity of the protective sheath 11 and the provision of the gap 12 between the protective sheath and the movable valve part as in the embodiment shown in FIG. 1.

Figure 3:
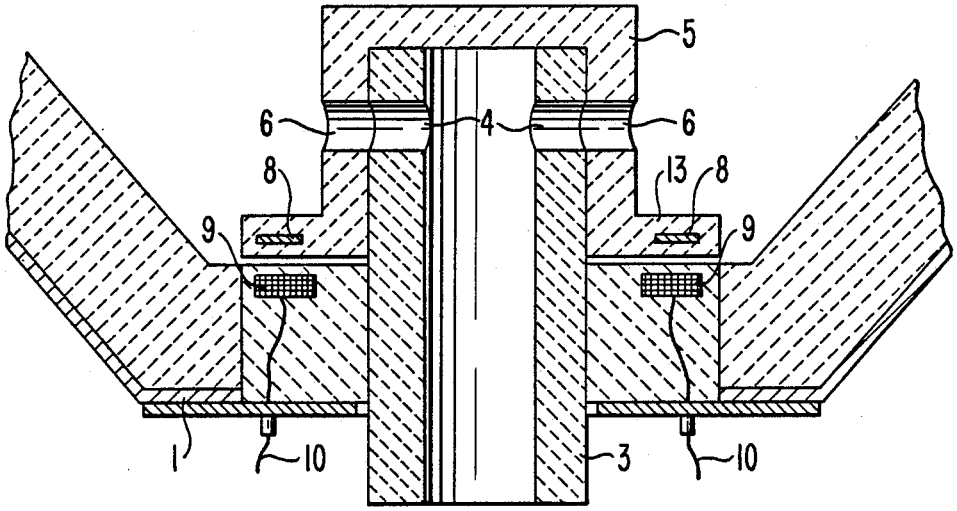
FIG. 3 is a schematic sectional view of yet another embodiment of a rotary valve according to the present invention.

In the embodiment shown in FIG. 3, the outer valve part having a tubular shape with one closed end includes a brim 13 extending around the other end thereof. The first component 8 of the electromagnetic drive means is disposed within the brim 13. Furthermore, the second component 9 of the electromagnetic drive means is embedded in the lining 1 below the brim 13 whereby the coils of the second component 9 are shielded by the brim 13 from the molten metal.

The operation of the valves shown in the embodiments of FIGS. 2 and 3 is substantially the same as that described with respect to the embodiment shown in FIG. 1.

Figure 4:
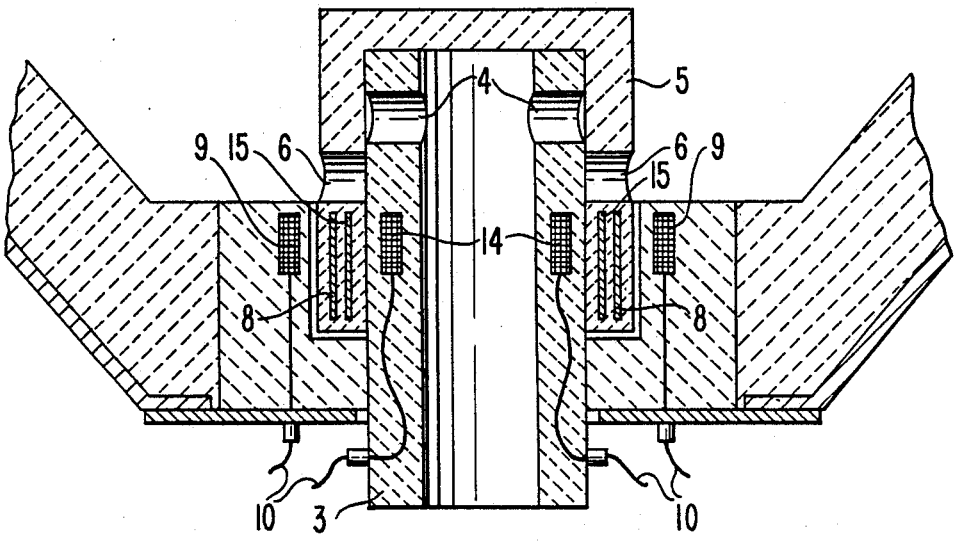
FIG. 4 is a schematic sectional view of a rotary and axial slide plate valve according to the present invention.

In the embodiment shown in FIG. 4, the movable valve part 5 is not only rotatable by the electromagnetic drive means about the longitudinal axis of the fixed valve part 3 but is also movable along said axis. In one closed position of the valve illustrated in FIG. 4, the through-holes 6 are closed to the channel extending in the fixed valve part 3 by the seal established by the peripheral surfaces of the valve parts, i.e. the through-holes 4, 6 are not axially aligned and cannot be aligned by rotating the movable valve part 5 until the movable valve part 5 is moved axially upwards.

To facilitate this axial movement, another component 14 of the electromagnetic drive means, i.e. another coil, integral with the fixed valve part 3 is disposed concentric to the axis. The electromagnetic drive means includes an additional component 15, i.e. another set of permanent magnets or iron cores associated with the component 14 of the electromagnetic drive means. The component 14 of the electromagnetic drive means could alternatively be provided integral with the lining of the vessel.

When current is passed through the magnetic coil constituting the component 14 of the electromagnetic drive means, the movable valve part 5 is raised until the throughholes 6 extend within a plane passing through the throughholes 4. When the polarity is reversed or the current is switched off, the movable valve part 5 returns to the position shown in FIG. 4. This position may be dictated by the static pressure of the molten metal within a gap defined between movable valve part 5 and the lining of the vessel.

As in the embodiments described above, the second component 9 is employed to rotate the movable valve part 5 along with a first set of permanent magnets or iron cores.

Figure 5:
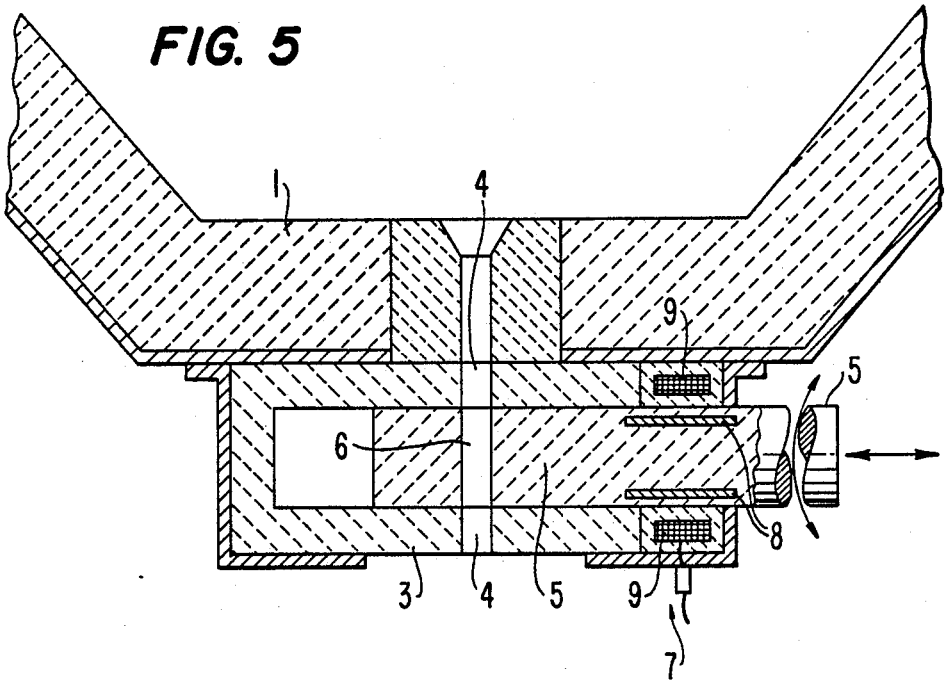
FIG. 5 is a schematic sectional view of another embodiment of a rotary and axial slide plate valve according to the present invention.

Turning now to the valve of the present invention shown in FIG. 5, the fixed valve part 3 defines an outer valve part of the valve that is mounted to the vessel at the bottom exterior thereof. On the other hand, the movable valve part 5 defines an inner valve part of the valve. The through-holes 4 of the fixed valve part 3 define an inlet port and an outlet port of the valve which may be selectively aligned with the through-holes 6 of the movable valve part 5 by axial and/or rotary movement of the movable valve part 5. Again, the first component 8 of the electromagnetic drive means comprising at least one permanent magnet or at least one iron core is integral with the movable valve part 5 while the second component 9 of the electromagnetic drive means 7 comprising a respective coil associated with each permanent magnet or iron core, is integral with the fixed valve part 3. In the figure, when current passes through the first component 9, the movable valve part 5 may be rotated to the open and closed positions of the valve. Further components of the electromagnetic drive means 7 can be provided in order to facilitate axial movement of the movable valve part 5.

Figure 6:
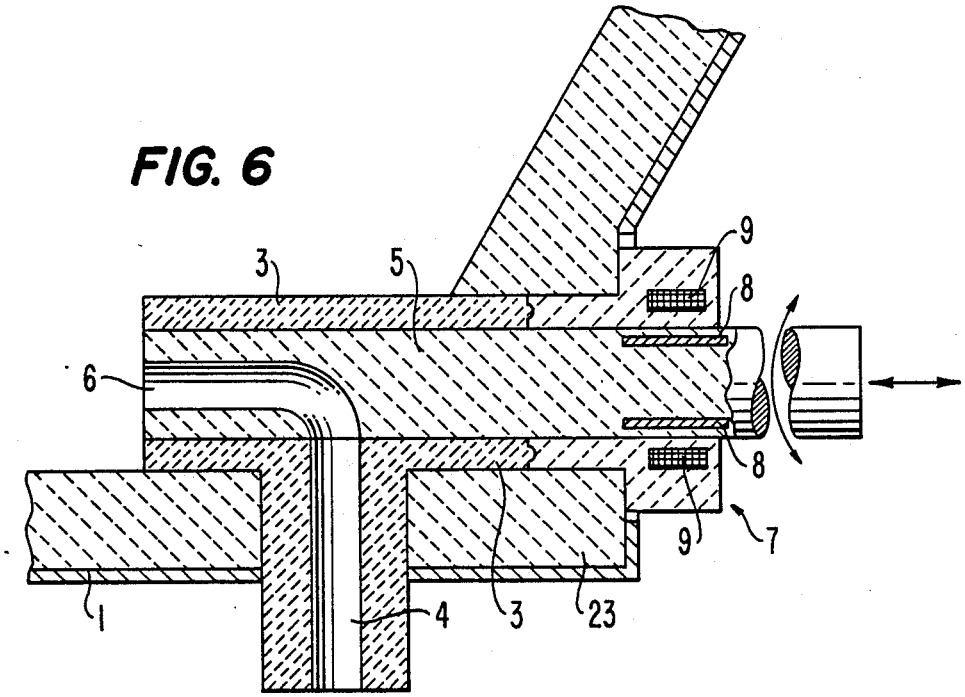
FIG. 6 is a schematic sectional view of yet another embodiment of a rotary and axial slide plate valve according to the present invention.

In the embodiment shown in FIG. 6, again, the fixed valve part 3 is formed as the outer valve part of the valve; however, in this embodiment the fixed valve part is embedded in the refractory lining 1 of the vessel so as to be fixedly connected thereto. The movable valve part 5 is formed as the inner valve part and extends into the fixed valve part 3 from outside of the vessel. The movable valve part 5 like that in the embodiment shown in FIG. 5, may comprise a solid cylindrical body have a through-hole extending therethrough. In the embodiment of FIG. 6, the through-hole 6 extends contiguously from an end of the solid body to a peripheral surface thereof. When the valve is in the open position, the through-hole 6 defining a channel in the movable valve part 5 is open between an inlet port of the fixed valve part 3 defined by an open end of the main tubular body thereof and a through-hole 4 of the fixed valve part 3 defining an outlet of the valve. In FIG. 6, only the components for rotating the movable valve part 5 relative to the fixed valve part 3 are shown, the first component 8 comprising at least one permanent magnet or at least one iron core integral with the movable valve part 5 and the second component 9 comprising at least one coil disposed outside of the metallurgical vessel.

Figure 8:
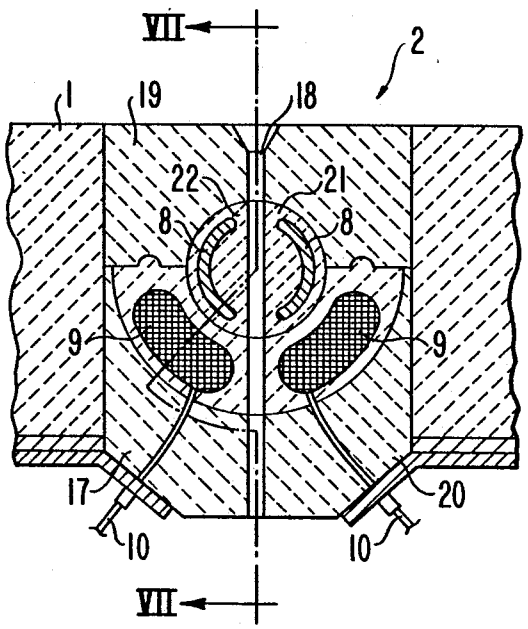
FIG. 8 is a schematic sectional view of the rotary valve shown in FIG. 7 as taken along line VIII—VIII therein.
Figure 7:
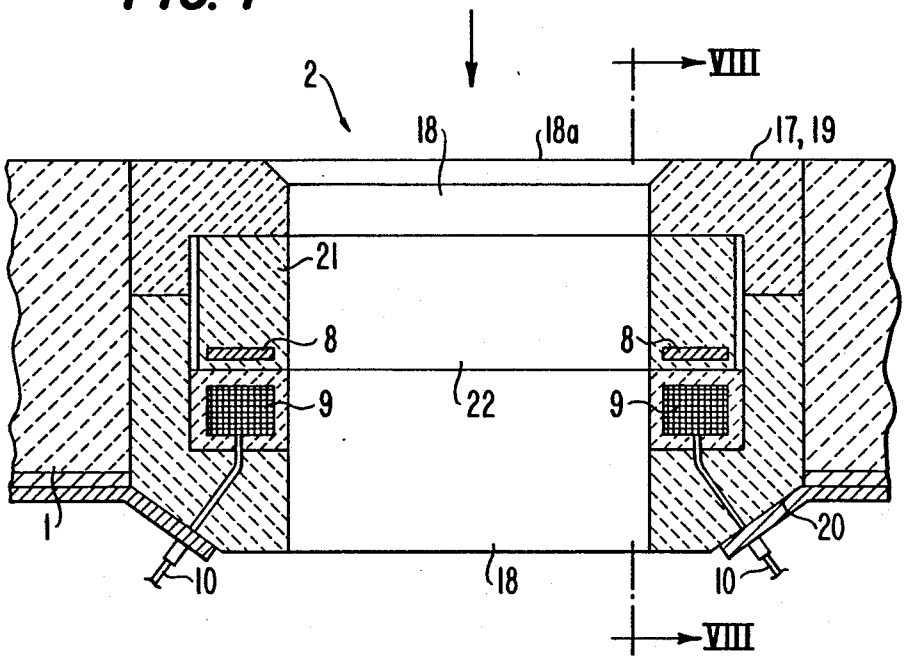
FIG. 7 is a schematic sectional view of a rotary valve as an elongated discharge nozzle according to the present invention, as taken along line VII—VII of FIG. 8.

Turning now to FIGS. 7 and 8 showing an embodiment of the present invention that is usable as a discharge nozzle for casting thin slabs from a metallurgical vessel, the valve 2 includes a fixed valve part or stator 17 constituting an outer valve part of the valve and a movable valve part or rotor 21 constituting an inner valve part of the valve. The stator 17 has a through-hole 18 extending diametrically through a central portion thereof to form a channel in the shape of an elongated slot and an inlet port 18*a* of the valve. A recess is defined within the stator 17 that is open to and extends transversely of the elongated slot 18 and in which recess the rotor 21 is fitted. Furthermore, the stator comprises an upper portion 19 and a lower portion 20 abutting one another at surfaces thereof disposed in a plane of separation passing through the recess. In other words the separation of the portions of the stator along said plane of separation results in access to the rotor 21.

The rotor 21 is rotatable within the stator 17 about an axis extending generally horizontally. The rotor has a through-hole 22 defining a channel in the valve having a cross-sectional area as taken in a horizontal plane that is substantially equal to the cross-sectional area of the elongated slot 18.

The electromagnetic drive means 4 rotating the stator 21 includes a first component 8 comprising at least one permanent magnet or iron core integral with the rotor 21 at each end thereof. The second component 9 of the electromagnetic drive means comprises coils integral with the stator 17 disposed below the recess at each side of elongated slot 18.

In FIGS. 7 and 8, the valve is shown in the open position, i.e. the through-hole 22 of the rotor 21 is aligned with the elongated slot 18. The rotor 21 is brought to this position by passing current through the magnetic coils of the electromagnetic drive means. By reversing the current flow through the magnetic coils, the rotor 21 can be rotated to a position at which the through-hole 22 is no longer aligned with the elongated slot 18 whereby the seal established between the peripheral surfaces of the rotor 21 and the stator 17 close the inlet port 18*a* of the valve 2.

The valve 2 shown in FIGS. 7 and 8 can also be modified so that the rotor 21 extends outwardly of the stator 17 and through the metallurgical vessel to the outside thereof. In such a modification, it is possible to dispose the electromagnetic drive means outside of the vessel.

Finally, it is to be noted that in any of the embodiments described above, when the movable valve part is in the open position or the closed position of the valve, the electromagnetic drive means may be operated to slightly oscillate the movable valve part so as to prevent the molten metal from hardening at the interface between the movable and fixed valve parts.

Although the present invention has been described and illustrated with respect to preferred embodiments thereof, it is to be understood that modifications and changes may be made to the specifically described and illustrated features without departing from the scope of the present invention.

I claim:

1. Valve structure for controlling the discharge of molten metal in a substantially downward direction from a metallurgical vessel, said valve structure comprising:

a refractory outer valve part defining an inlet port of the valve, and having therein a recess defined by an inner peripheral surface;

a refractory inner valve part at least partially fitted within said recess, said inner valve part having a channel extending therein, and an outer peripheral surface complementary to and contacting the inner peripheral surface of said refractory outer valve part so as to establish a seal therebetween, one of said valve parts fixable to a metallurgical vessel, and the other of said valve parts movable relative to said one of said valve parts between an open position of the valve at which said channel is open to said inlet port and a closed position of the valve at which said inlet port is closed by the seal established between the peripheral surfaces of said inner and said outer valve parts; and a first component of an electromagnetic drive means for moving said other of said valve parts between said open and said closed positions, said first component being integral with said other of said valve parts.

2. Valve structure as claimed in claim 1, further comprising a second component of the electromagnetic drive means integral with said one of said valve parts.

3. Valve structure as claimed in claim 1, wherein said first component is at least one permanent magnet or at least one iron core.

4. Valve structure as claimed in claim 2, wherein said first component is at least one permanent magnet or at least one iron core, and said second component is at least one coil.

5. Valve structure as claimed in claim 1, wherein said one of the valve parts has the shape of a pipe, said other of said valve parts also has the shape of a pipe and is concentric to said one of the valve parts, and further comprising a second component of the electromagnetic drive means integral with said one of said valve parts, one of said components comprising at least one permanent magnet or at least one iron core and the other of said components comprising at least one coil.

6. Valve structure as claimed in claim 5, wherein said other of said valve parts is disposed around said one of said valve parts, said one of said components is said first component and comprises first and second permanent magnets or first and second iron cores, and said other of said valve parts is rotatable and axially slidable relative to said one of said valve parts by the electromagnetic drive means.

7. Valve structure as claimed in claim 1, wherein said one of said valve parts is said outer valve part and is fixable to the metallurgical vessel at the exterior thereof, said first component comprises at least one permanent magnet or at least one iron core, and further comprising a second component of the electromagnetic drive means integral with said one of said valve parts at an end thereof, said second component comprising at least one coil.

8. Valve structure as claimed in claim 1, wherein said one of said valve parts is said outer valve part and is fixable to the metallurgical vessel at an inner refractory lining thereof with an end of the inner valve part extending from the vessel, said first component comprises at least one permanent magnet or at least one iron core disposed at the end of said inner valve part, and further comprising a second component of the electromagnetic drive means integral with said one of said drive parts, said second component comprising at least one coil.

9. Valve structure as claimed in claim 1, wherein said valve is usable as a nozzle of the metallurgical vessel, said one of said valve parts comprising a stator and said other of said valve parts comprising a rotor having opposite ends seated in said recess, and said first component is integral with said rotor at at least one of said ends thereof.

10. Valve structure as claimed in claim 9, wherein said first component comprises at least one permanent magnet or at least one iron core disposed at each of said ends of said rotor, and further comprising a second component of said electromagnetic drive means integral with said stator, said second component comprising a respective coil associated with each said permanent magnet or iron core.

11. A refractory valve part for use in a valve for controlling the discharge of molten metal in a substantially downward direction from a metallurgical vessel, said refractory valve part being fixable to the metallurgical vessel, defining an outlet of the valve, and having integral therewith at least one coil of an electromagnetic drive means for driving the valve between open and closed positions.

12. A refractory valve part as claimed in claim 11, having a tubular shape.

13. A refractory valve part as claimed in claim 11, that also defines an inlet port of the valve.

14. A refractory valve part as claimed in claim 12, that also defines an inlet of the valve, said inlet and said outlet extending radially therethrough, and said at least one coil being integral with said part at an end thereof.

15. A refractory valve part as claimed in claim 11, having a tubular main body that defines an outlet port of said valve and an inlet port of the valve, and a nozzle-like extension extending radially from said tubular main body and defining therein an outlet channel open to said outlet port, said at least one coil disposed at an end of said tubular main body.

16. A refractory valve part as claimed in claim 11, and defining therein a recess open to and extending transversely across said outlet, a respective said coil disposed adjacent at least one end of said recess.

17. A refractory valve part as claimed in claim 16, and comprising an upper portion and a lower portion abutting one another at surfaces thereof disposed in a plane of separation passing through said recess.

18. A refractory valve part for use in a valve for controlling the discharge of molten metal in a substantially downward direction from a metallurgical vessel, said refractory valve part being movable in the valve, and having integral therewith at least one permanent magnet or at least one iron core of an electromagnetic drive means for driving the valve part between open and closed positions of the valve.

19. A refractory valve part as claimed in claim 18, having a tubular shape closed at only one end, and an inlet of the valve extending radially therethrough, and wherein said at least one permanent magnet or at least one iron core is disposed at the other end thereof.

20. A refractory valve part as claimed in claim 18, having a tubular shape closed at only one end, an inlet of the valve extending radially therethrough, and a brim extending around the other end thereof, and wherein said at least one permanent magnet or at least one iron core is disposed in said brim.

21. A refractory valve part as claimed in claim 18, and having a solid body with a channel extending therethrough, and wherein said at least one permanent magnet or at least one iron core is disposed at an end of said solid body.

22. A refractory valve part as claimed in claim 21, wherein said channel extends transversely to a longitudinal axis of said part.

23. A refractory valve part as claimed in claim 21, wherein said solid body is cylindrical, and said channel extends contiguously from one end of said body to the cylindrical peripheral outer surface of said body, and wherein said at least one permanent magnet or at least one iron core is disposed at the other end of said body.

24. A refractory valve part as claimed in claim 21, wherein said solid body is cylindrical, and said channel is a slot extending diametrically through a central portion of said body, and wherein a respective said permanent magnet or iron core is disposed at at least one end of said body.

25. An assembly for controlling the discharge of molten metal from a metallurgical vessel, said assembly comprising:

a valve including a refractory outer valve part defining an inlet port of the valve, and a recess defined by an inner peripheral surface, and a refractory inner valve part at least partially fitted within said recess, said inner valve part having a channel extending therein, and an outer peripheral surface complementary to and contacting the inner peripheral surface of said refractory outer valve part so as to establish a seal therebetween;

refractory material for lining at least a portion of the metallurgical vessel, one of said valve parts being fixedly connected to said refractory material, the other of said valve parts being movable relative to said one of said valve parts between an open position of the valve at which said channel is open to said inlet port and a closed position of the valve at which said inlet port is closed by the seal established between the peripheral surfaces of said inner and said outer valve parts; and an electromagnetic drive means for moving said other of said valve parts between said open and said closed positions, said electromagnetic drive means comprising a first component integral with said other of said valve parts, and a second component integral with said lining.

26. An assembly as claimed in claim 25, wherein said first component comprises at least one permanent magnet or at least one iron core, and said second component comprises at least one coil.

27. An assembly as claimed in claim 25, wherein said second component is embedded in said lining.

28. An assembly as claimed in claim 25, wherein said electromagnetic drive means also includes at least one coil integral with said other of said valve parts, each said coil associated with a respective said permanent magnet or iron core, said other of said valve parts being rotatable and axially slidable relative to said one of said valve parts by said electromagnetic drive means.

29. An assembly as claimed in claim 25, wherein said first component comprises at least one permanent magnet or at least one iron core, and said second component comprises at least one coil embedded in a protective sheath, at least a portion of said sheath exposed at the exterior of said lining.

* * * * *

UNITED STATES PATENT AND TRADEMARK OFFICE

CERTIFICATE OF CORRECTION

PATENT NO. : 4,905,876

DATED : March 6, 1990

INVENTOR(S) : Jose GIMPERA

It is certified that error appears in the above-identified patent and that said Letters Patent is hereby corrected as shown below:

On the title page, item [57]:
In the ABSTRACT, line 1, "plate" has been deleted.

Signed and Sealed this

Twenty-second Day of January, 1991

*Attest:*

HARRY F. MANBECK, JR.

*Attesting Officer*

*Commissioner of Patents and Trademarks*